US007173564B2

(12) United States Patent
Park et al.

(10) Patent No.: US 7,173,564 B2
(45) Date of Patent: Feb. 6, 2007

(54) ANTENNA FOR ULTRA-WIDE BAND COMMUNICATION

(75) Inventors: Jae Yeong Park, Seoul (KR); Seok Ho Choi, Chungcheongnam-do (KR); Jong Kweon Park, Daejeon (KR); Sun Kyung Kim, Daejeon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/894,013

(22) Filed: Jul. 20, 2004

(65) Prior Publication Data

US 2005/0052322 A1 Mar. 10, 2005

(30) Foreign Application Priority Data

Jul. 21, 2003 (KR) ..... 10-2003-0049755

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS

| | | | | |
|---|---|---|---|---|
| 6,008,774 | A | 12/1999 | Wu | 343/828 |
| 6,236,367 | B1 * | 5/2001 | Du Toit et al. | 343/700 MS |
| 6,249,254 | B1 | 6/2001 | Bateman et al. | 343/700 MS |
| 6,317,084 | B1 * | 11/2001 | Chen et al. | 343/700 MS |
| 6,359,589 | B1 * | 3/2002 | Bae | 343/700 MS |
| 6,683,573 | B2 * | 1/2004 | Park | 343/700 MS |
| 6,822,610 | B2 * | 11/2004 | Yeh | 343/700 MS |
| 2001/0043157 | A1 * | 11/2001 | Luk et al. | 343/700 MS |
| 2003/0132882 | A1 | 7/2003 | Wong et al. | 343/700 MS |

FOREIGN PATENT DOCUMENTS

WO WO 03/023900 A1 3/2003

* cited by examiner

*Primary Examiner*—Hoanganh Le
*Assistant Examiner*—Tung Le
(74) *Attorney, Agent, or Firm*—Birch, Stewart, Kolasch & Birch, LLP

(57) ABSTRACT

An antenna for ultra-wide band communication is disclosed. The antenna includes a substrate, a patch formed on one side of the substrate so as to be smaller than the substrate, and being excited when an electric current is supplied through a feeder line, so as so radiate energy, and a ground area formed by removing a portion of another side of the substrate so as to obtain a wide band characteristic.

18 Claims, 11 Drawing Sheets

ANTENNA FOR ULTRA-WIDE BAND COMMUNICATION

CROSS-REFERENCE TO RELATED APPLICATIONS

This application claims the benefit of Korean Application No. P2003-049755, filed on Jul. 21, 2003, which is hereby incorporated by reference as if fully set forth herein.

BACKGROUND OF THE INVENTION

1. Field of the Invention

The present invention relates to an ultra-wide band antenna, and more particularly, to an antenna for ultra-wide band communication. Although the present invention is suitable for a wide scope of applications, it is particularly suitable for fabricating an antenna having a compact size, being light weight, and having a low fabrication cost.

2. Discussion of the Related Art

The ultra-wide band (UWB) communication is a wireless communication method, which was first developed by the United States Department of Defense in the 1960's and used for military purposes. The UWB communication has a wide frequency band, a low power consumption, and a fast transmission speed. Also, the UWB communication forms a spectrum of a level lower than that of a white noise in a code division multiple access (CDMA) communication. Thus, the listening-in or cutting-off of signals becomes difficult, thereby being suitable for maintaining security. Moreover, unlike the conventional communication system, the UWB communication system performs communication using pulses. Recently, due to such characteristics, the UWB communication has been considered to be a next generation wireless data communication method, research on which is being extensively carried out worldwide.

Due to the many advantages of the UWB communication, the UWB communication is expected to be used extensively in various systems, such as personal communication networks or home networks connecting personal computers (PC), television receivers (TV), personal digital assistants (PDA), digital versatile discs (DVD), digital cameras, and printers, which are within a close range of 10 meters (m), global positioning systems, automobile collision avoidance systems, and medical apparatuses. The current UWB communication system is currently being standardized at a vast rate, starting from the United States. Many related corporations and university research laboratories have founded a mutual technology research group called the Ultra Wideband Working Group (UWBWG), which carries out many active studies. The level of interest is also increasing in the related fields in Korea by holding diverse forums and so on.

Recently, in the United States, the Federal Communications Commission (FCC) has approved the usages of the UWB communication bandwidth ranging from 3.1 to 10.6 gigahertz (GHz), in order to eliminate radio frequency interference with the conventional mobile communication system and the global positioning system (GPS). Herein, the transmission range has also been limited to within 9 meters (m). Therefore, in the related industry, the UWB communication is being considered as a new alternative for the wireless personal area network (WPAN), and applications of the UWB communication method are being actively and extensively developed.

However, one of the most important factors in the development of the UWB communication system is the development of an ultra-wide band antenna. More specifically, the UWB communication system has many advantages, such as very high speed communication, high amount of transmission, excellent obstacle transmission, a simple structure of receiver/transmitter, low transmission power, and so on. Herein, the UWB antenna acts as an essential assembly part for representing the UWB communication system having the above-described advantages.

In order to ensure the mobility of the UWB antenna, the UWB antenna should be formed to have the characteristics of compact size, simple and easily fabrication method, and low product cost. Additionally, the UWB antenna should also have a structure having a constant impedance value independent from the corresponding frequency. Furthermore, the UWB antenna should also have little distortion in the pulse signal. However, the development of such antenna has brought about many difficulties. And, a wide range of researchers has been globally participating in the development of an ultra-wide band antenna. Recently, only a few companies, such as Skycross, Timedomain, Taiyo-Yuden, and so on, have presented their mock-up products of the UWB antenna.

SUMMARY OF THE INVENTION

Accordingly, the present invention is directed to an antenna for ultra-wide band communication that substantially obviates one or more problems due to limitations and disadvantages of the related art.

An object of the present invention is to provide an antenna for ultra-wide band communication being of a compact size and light weight, and having a low fabrication cost.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an antenna for ultra-wide band communication includes a substrate, a patch formed on one side of the substrate so as to be smaller than the substrate, and being excited when an electric current is supplied through a feeder line, so as so radiate energy, and a ground area formed by removing a portion of another side of the substrate so as to obtain a wide band characteristic.

Herein, the substrate is a printed circuit board. The substrate may be formed of any one of low resistance silicon, glass, alumina, teflon, epoxy, low temperature co-fired ceramic.

The patch is formed to have a center frequency of 5.8 gigahertz (GHz). The patch may be formed in a shape of any one of a circle, a triangle, a rectangle, and a polygon. Herein, an air gap slot is formed in the patch, so as to control a frequency band. The air gap slot is formed in a shape of any one of a circle, a triangle, a rectangle, and a polygon.

Additionally, a plurality of matching stubs is formed between the patch and the feeder line, so as to perform an impedance matching between the patch and the feeder line. Each of the matching stubs may be formed in a shape of any one of a rectangle, a trapezoid, and a circle, and is formed in one of a singular form and an array form. Herein, one of the matching stubs being adjacent to the feeder line has a width smaller than that of another one of the matching stubs.

The ground area is formed in a single patch form, and an air gap slot is formed within the ground area. Herein, the air gap slot is formed in a shape of any one of a circle, a triangle, a rectangle, and a polygon. Furthermore, the patch is formed on the substrate in one of a single-layered structure and a multi-layered structure.

It is to be understood that both the foregoing general description and the following detailed description of the present invention are exemplary and explanatory and are intended to provide further explanation of the invention as claimed.

BRIEF DESCRIPTION OF TIRE DRAWINGS

The accompanying drawings, which are included to provide a further understanding of the invention and are incorporated in and constitute a part of this application, illustrate embodiments of the invention and together with the description serve to explain the principle of the invention. In the drawings.

Figure 8A:
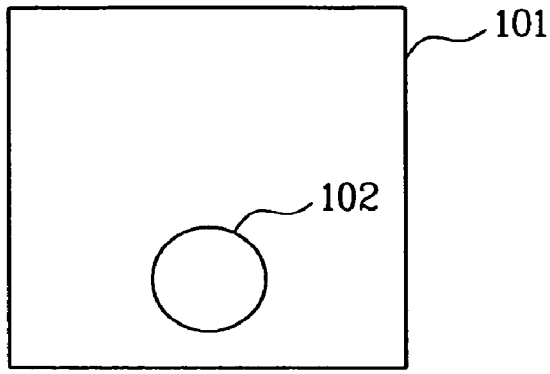
Figure 8B:
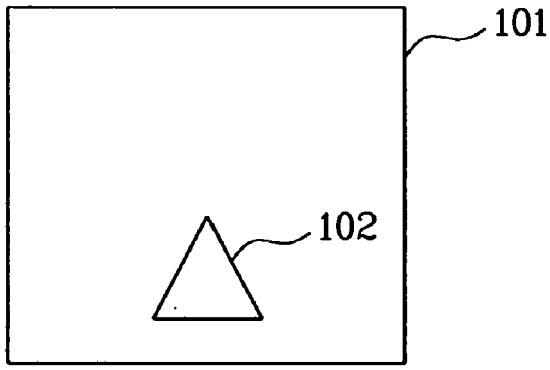
Figure 8C:
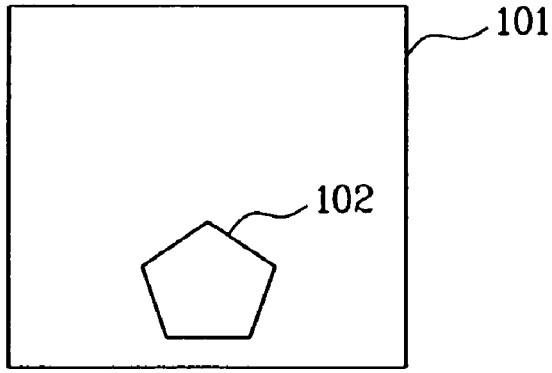
Figure 9A:
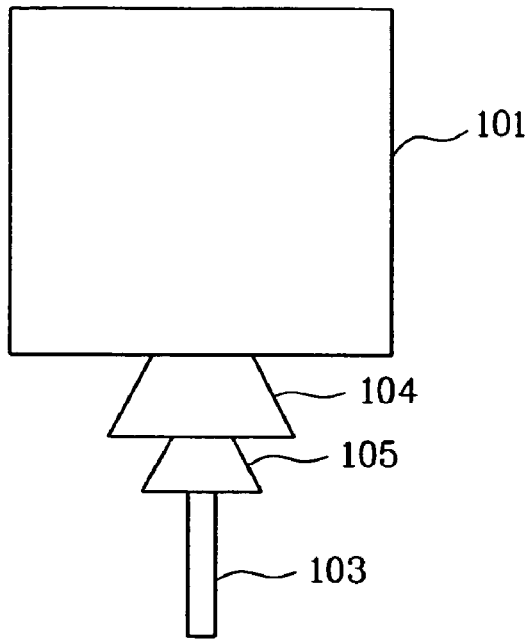
Figure 9B:
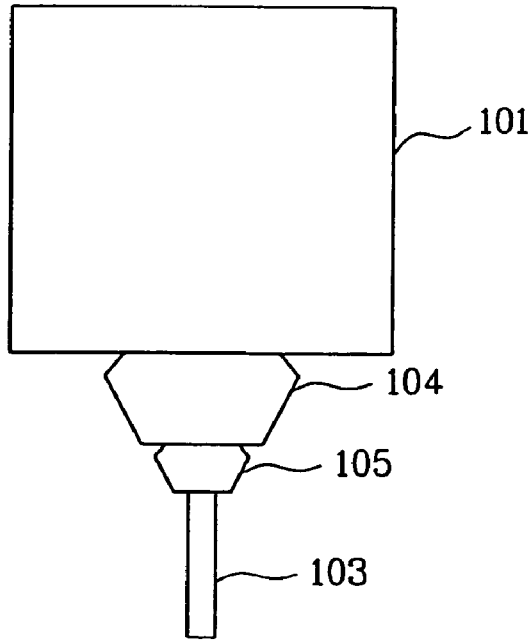
Figure 9C:
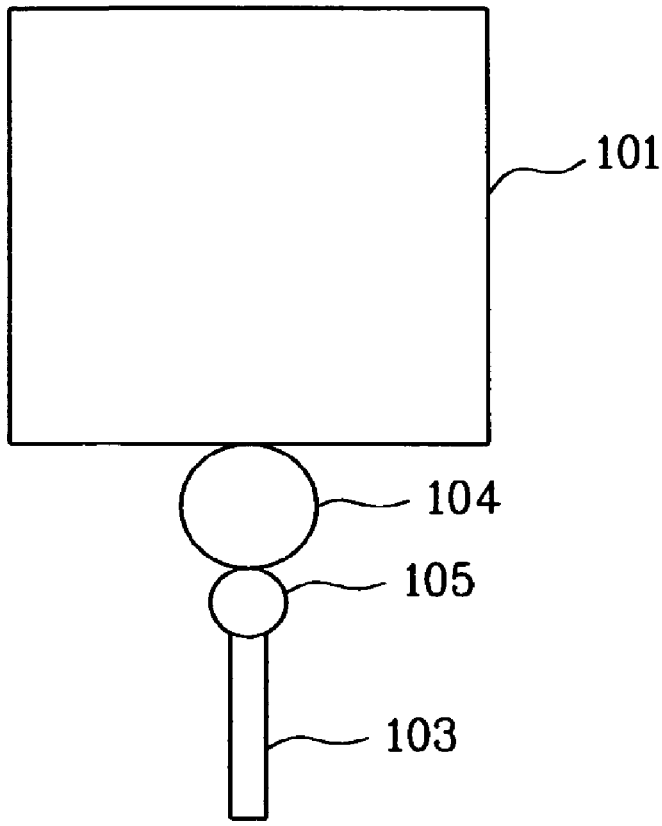
Figure 10:
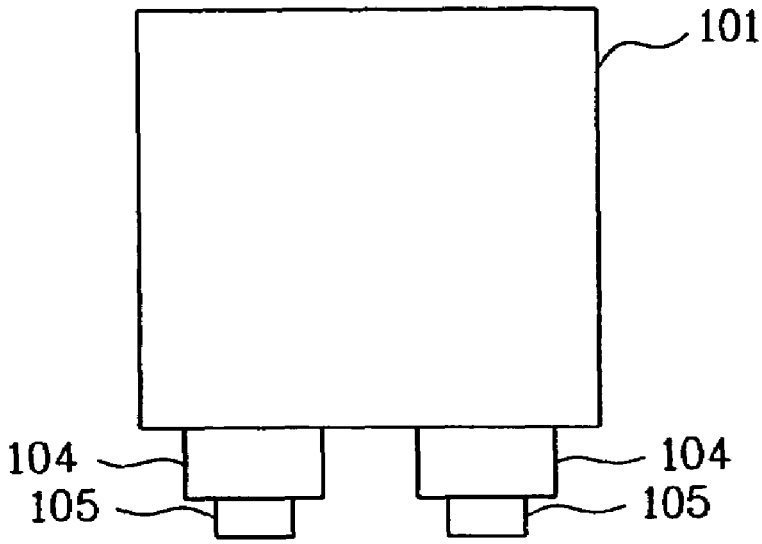

FIGS. 7(*a*)–7(*d*) illustrate different shapes of a patch;

FIGS. 8(*a*)–8(*c*) illustrate different shapes of air gap slots;

FIGS. 9(*a*)–9(*c*) illustrate different shapes of matching stubs;

FIG. 10 illustrates an array form of matching stubs; and

Figure 11:
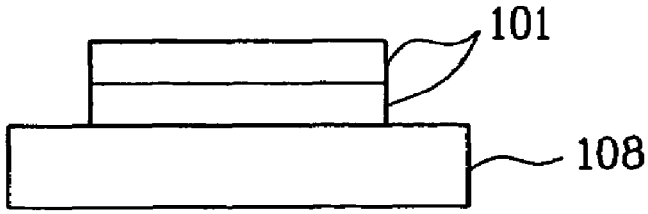

FIG. 11 illustrates a multi-structure patch antenna.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
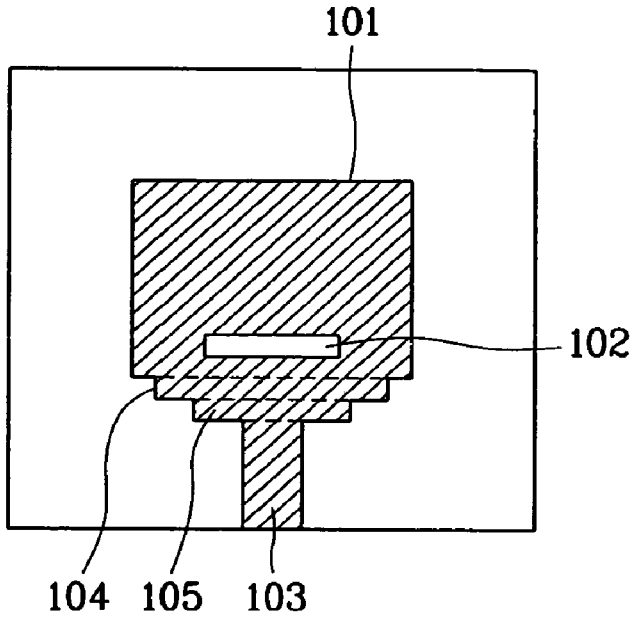
FIG. 1 illustrates a front side view of an ultra compact size antenna for ultra-wide band communication according to the present invention.
Figure 2:
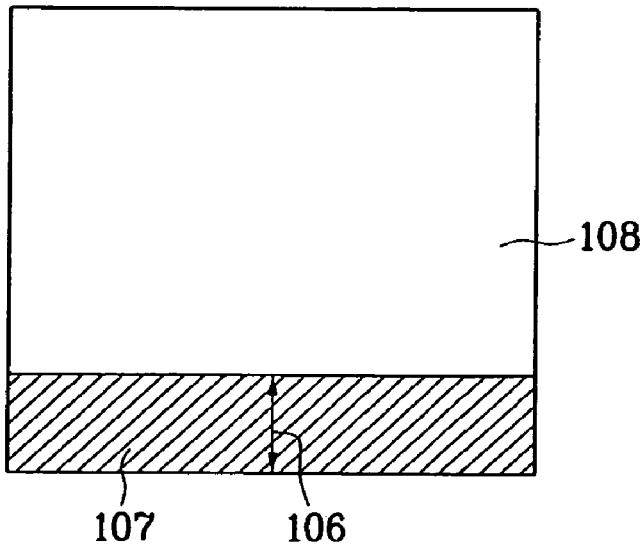
FIG. 2 illustrates a rear side view of the ultra compact size antenna for ultra-wide band communication according to the present invention.

The antenna for ultra-wide band communication is a flat patch antenna, which has been devised to receive ultra-wide band (UWB) communication frequency band (i.e., ranging from 3.4 to 10.6 gigahertz (GHz)) and to have characteristics of compact size and light weight. FIGS. 1 and 2 illustrate the ultra compact size antenna for ultra-wide band communication, wherein FIG. 1 illustrates the front side view and FIG. 2 illustrates the rear side view.

Referring to FIG. 1, in the antenna for UWB communication according to the present invention, a patch 101 is formed on a surface (or one side) of a substrate 108, wherein the patch 101 is designed to have a center frequency of 5.8 gigahertz (GHz). At this point, as shown in FIGS. 7(*a*)–(*d*), respectively, the shape of the patch 101 can be one of a circle, a triangle, a square or rectangle, a polygon, and so on, without limitations. However, the rectangular or round shapes are most widely used for the simplicity of the description. In the description of the present invention, the rectangular shaped patch 101 will be given as an example in the embodiment of the present invention.

In addition, an air gap slot 102 is formed in the patch 101, so as to control the frequency and reduce the size of the antenna. More specifically, by controlling the bandwidth through the air gap slot 102, the frequency can be controlled to be similar to the UWB communication bandwidth, which ranges from 3.1 to 10.6 gigahertz (GHz). As shown in FIGS. 8(*a*)–8(*c*), the shape of the air gap slot 102 can be one of a circle, a triangle, a square or rectangle, a polygon, and so on, without limitations. In the embodiment of the present invention, the air gap slot 102 has a rectangular shape.

As shown in FIG. 2, a set portion of another surface of the substrate 108 is removed to form a ground 107. In the present invention, the surface area of the ground 107 is reduced, so that the frequency bandwidth can become a wide band. The ground 107 can be formed as a single patch shape, and an air gap slot of various shapes can also be formed on the ground 107.

Referring to FIG. 1, matching stubs 104 and 105 are formed between a feeder line 103 and the patch 101 for an impedance matching between the feeder line 103 and the patch 101. Herein, the feeder line 103 refers to a cable electrically connecting a receiver and an antenna or connecting a receiver and a feed point of the antenna, so as to transmit a high frequency power. The matching stub refers to a branch circuit or a lumped element fixed on a portion of a transmission cable, such as a twin parallel line, a coaxial line, a wave guide, and so on, so as to perform impedance matching. In other words, the matching stubs 104 and 105 are connected to the patch 101, thereby matching a 50 ohm (Ω) feeder line 103. Thus, the antenna for UWB communication can have a wider bandwidth (i.e., a bandwidth of 6 gigahertz (GHz)).

The matching stubs 104 and 105 can also be designed to have shapes other than a rectangle, such as shown in FIGS. 9(*a*)–9(*c*), respectively, a trapezoid, a polygon, or a circle, and the matching stubs 104 and 105 can also be designed to have an array form as shown in FIG 10. Herein, the width of the matching stub 105 is formed to be smaller than the width of the matching stub 104, thereby facilitating the flow of the radio waves. Moreover, the feeder line is formed of a coaxial cable having excellent characteristics of safety, shielding, low loss, voltage standing wave ratio (VSWR), and work efficiency.

In the embodiment of the present invention, a printed circuit board is used as the substrate 108. More specifically, an FR-4 substrate, which is the most widely used among printed circuit boards, is used as the substrate 108, thereby reducing the fabrication cost and allowing mass production of the present invention. Evidently, instead of the FR-4 substrate, low resistance silicon, glass, alumina, teflon, epoxy, low temperature co-fired ceramic, and so on can also be used as the substrate 108.

Herein, when the FR-4 printed circuit board is used as the substrate 108, the value of the dielectric constant (or permittivity) is 4.4, the height is 1.6 millimeters (mm), and the overall size of the antenna including the substrate is 30×35 square millimeters ($mm^2$), thereby allowing the antenna for UWB communication to be formed in a compact size. Meanwhile, the antenna for UWB communication according to the present invention can be formed substrate 108 in a single-layer form or a multi-layered form (see FIG. 11). The UWB antenna having the above-described structure can be formed in a patch structure having a rectangular shape, and can use the FR-4 printed circuit board, thereby reducing the fabrication cost and allowing mass production.

Meanwhile, the bandwidth of the antenna for UWB communication does not vary much depending upon the increase or decrease of the size of the rectangular patch 101, shown FIG. 1. However, if the size of the patch 101 increases, the frequency of the antenna for UWB communication makes a downward movement. Conversely, if the size of the patch 101 decreases, the frequency of the antenna for UWB communication makes an upward movement.

Also, by controlling the surface area of the ground 107, the antenna for UWB communication may have the characteristic of a wide band. More specifically, when a ground height 106 approaches a distance approximate to the rectangular patch 101, the voltage standing wave ratio (VSWR) becomes small. On the other hand, when the ground height 106 becomes further away from the rectangular patch 101, the VSWR becomes large. In other words, the VSWR value exceeds 2:1 at 6.5 gigahertz (GHz). In this case, the return amount becomes smaller as the VSWR decreases. Accordingly, if the VSWR is less than 2:1, it can be considered that the matching has been performed relatively accurately.

Therefore, an optimized value obtained through simulation is applied as the height of the ground 107. Similarly, optimum values of the matching stubs 104 and 105 are also obtained through simulation. Moreover, the rectangular slot 102 in the rectangular patch 101, shown in FIG. 1, not only controls the frequency, but can also reduce the size of the antenna, the optimum value of which can also be decided through simulation. The optimum value is decided while taking into consideration that the VSWR value becomes deficient as the width of the rectangular slot 102 becomes larger, and that an excessively long or short length of the rectangular slot 102 influences the bandwidth.

When performing the simulation in the present invention, the MicroWave Studio (MWS) of Computer Simulation Technology, Inc. (CST) is used as the simulation tool. However, the actual measurement results measured and obtained after fabricating the antenna for UWB communication were found to be similar to the simulation results. More specifically, the bandwidth was measured to be within the range of 3.4 to 12 gigahertz (GHz), which generally accommodates the frequency bandwidth required in the UWB communication system, which is within the range of 3.1 to 10.6 gigahertz (GHz).

Figure 3:
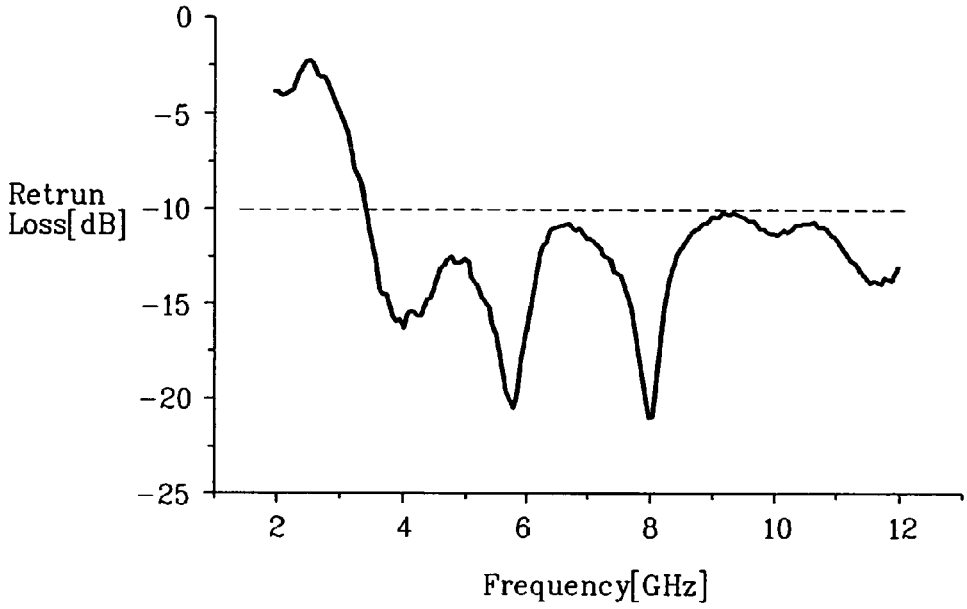
FIG. 3 illustrates a graph showing measurements of return loss in the antenna for ultra-wide band communication according to the present invention.

FIG. 3 illustrates a graph showing measurement results of return loss in the antenna for ultra-wide band (UWB) communication according to the present invention. Herein, the return loss is measured by using a network analyzer. Referring to FIG. 3, the antenna for UWB communication is shown to have a bandwidth ranging from 3.4 to 12 gigahertz (GHz) at a voltage standing wave ratio (VSWR) of 2:1.

Figure 4:
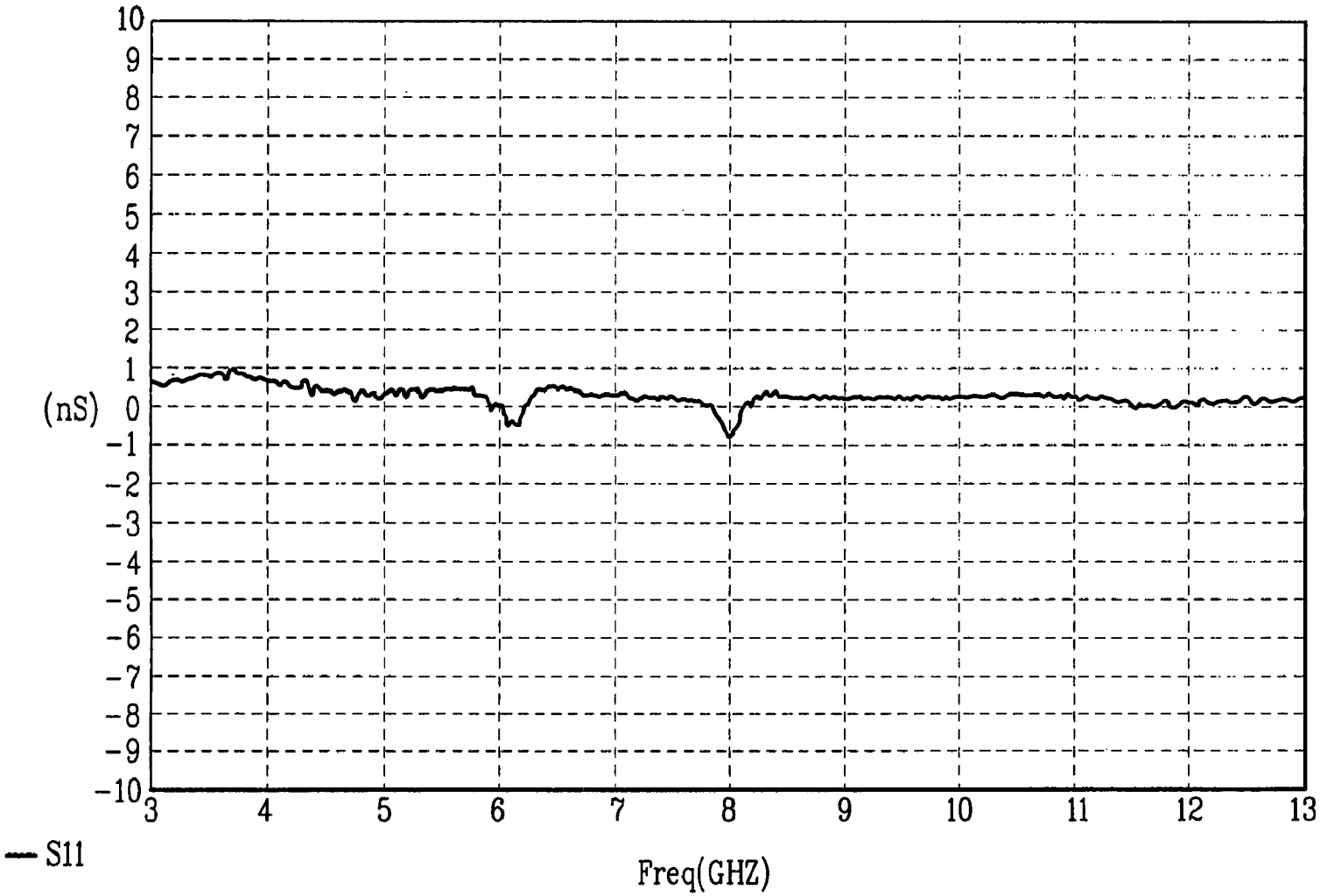
FIG. 4 illustrates a graph showing a group delay in the antenna for ultra-wide band communication according to the present invention.

FIG. 4 illustrates a graph showing a group delay in the antenna for ultra-wide band communication according to the present invention. The level of distortion in the pulse signal can be determined based depending upon the group delay. Therefore, the group delay may act as an essential parameter for the design and analysis of the antenna for UWB communication. Referring to FIG. 4, the antenna for UWB communication is shown to have a group delay of 2 nanoseconds (ns) demonstrating an excellent performance. This result may be considered to be similar to that of an antenna developed by other manufacturing companies.

Figure 5:
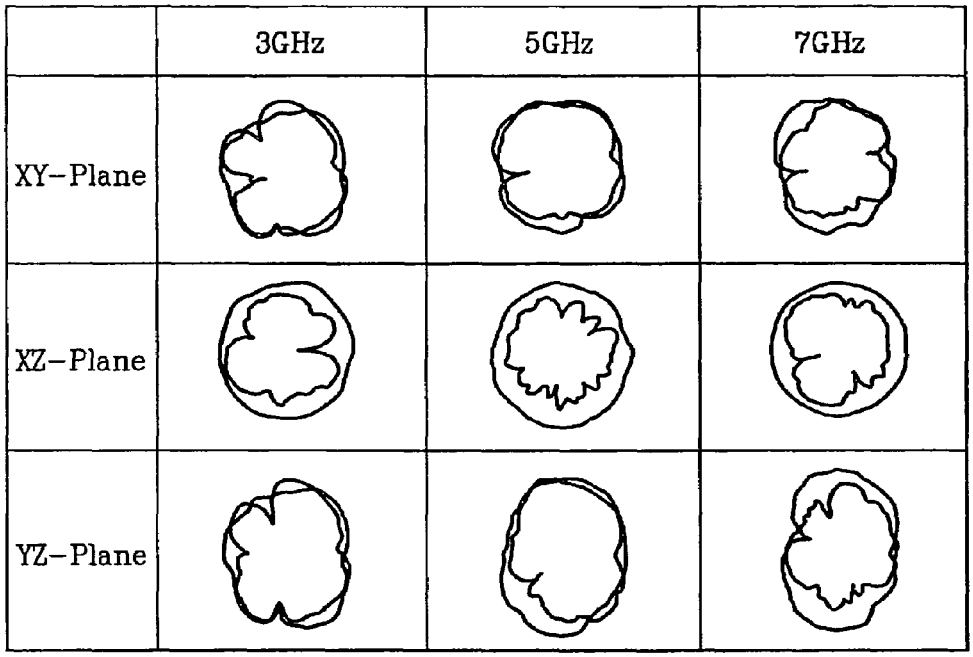
FIG. 5 illustrates samples showing measurements of radiation patterns in the antenna for ultra-wide band communication according to the present invention.

FIG. 5 illustrates samples showing measurements of radiation patterns in the antenna for ultra-wide band communication according to the present invention. Referring to FIG. 5, the antenna for UWB communication is shown to have an omni-directional characteristic in an XZ plane. Herein, such radiation pattern is similar to that of a dipole antenna.

Figure 6:
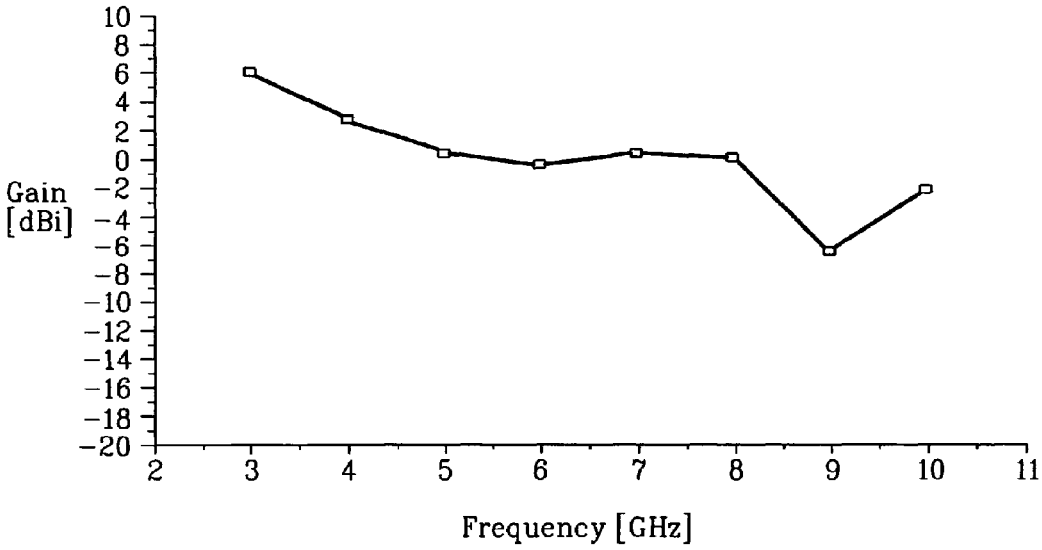
FIG. 6 illustrates a graph showing measurements of gain in the antenna for ultra-wide band communication according to the present invention.
Figure 7A:
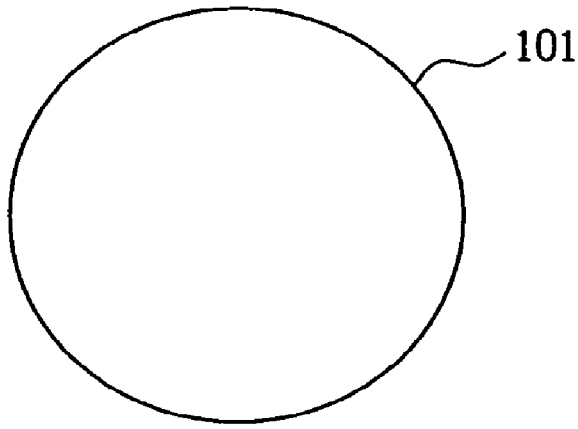
Figure 7B:
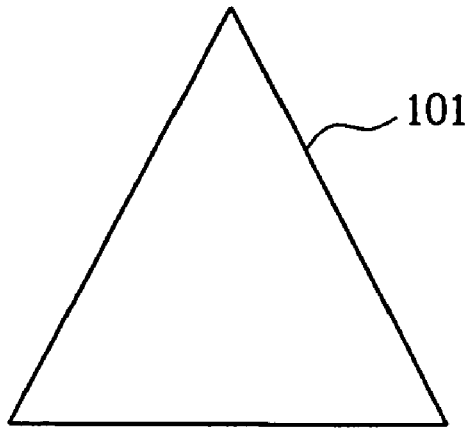
Figure 7C:
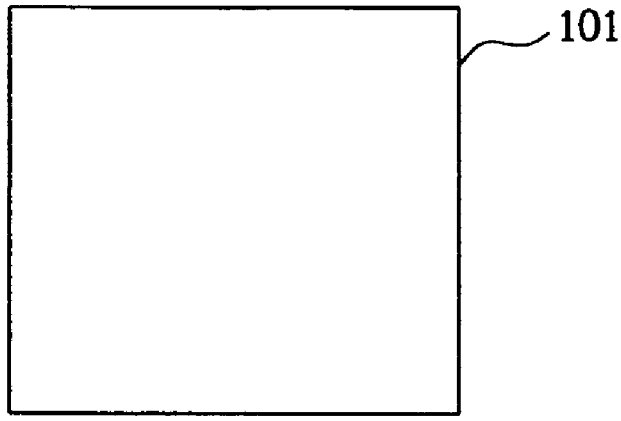
Figure 7D:
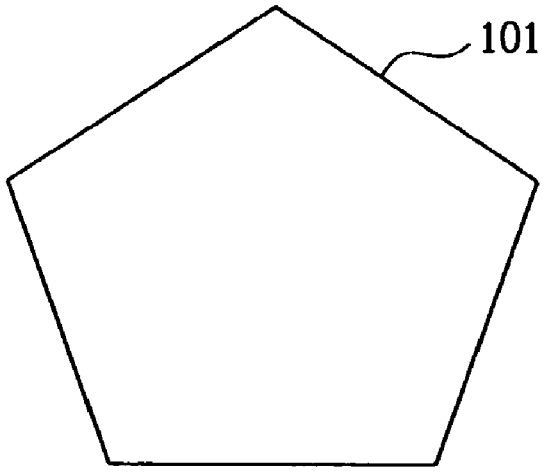

FIG. 6 illustrates a graph showing measurements of gain in the antenna for ultra-wide band communication according to the present invention. Referring to FIG. 6, when the antenna for UWB communication is at a UWB communication bandwidth of 3 gigahertz (GHz), the maximum gain is 6.03 decibels-isotropic (dBi) and the minimum gain is −6.67 decibels-isotropic (dBi).

The antenna for UWB communication and the UWB communication system according to the present invention can be extensively used in the areas of electric household appliance industry, personal computer industry, mobile phones, personal digital assistants (PDAs), medical equipments, automobile industry, and so on. As described above, the antenna for UWB communication according to the present invention can be formed to have the characteristics of compact size, light weight, excellent performance, and low product cost, by being fabricated as a flat patch antenna accommodating UWVB communication frequency bandwidth.

Moreover, the surface of a ground area is reduced, and a plurality of matching stubs is formed between the patch and the feeder line, thereby obtaining a wider bandwidth. Also, an FR-4 substrate is used, thereby reducing the fabrication cost and enabling mass production.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An antenna for ultra-wide band communication, comprising:

a substrate;

a patch formed on one side of the substrate so as to be smaller than the substrate, and being excited when an electric current is supplied through a feeder line, so as to radiate energy;

a ground area formed on another side of the substrate so as to obtain a wide band characteristic; and a plurality of matching stubs directly contacting each other and being formed between the patch and the feeder line, so as to perform an impedance matching between the patch and the feeder line, wherein the ground area extends from an edge of the substrate to a position that is less than a corresponding position of an edge of the patch formed on the one side of the substrate such that the ground area does not extend under the patch.

2. The antenna according to claim 1, wherein the substrate is a printed circuit board.

3. The antenna according to claim 1, wherein the substrate is formed of any one of low resistance silicon, glass, alumina, teflon, epoxy, low temperature co-fired ceramic.

4. The antenna according to claim 1, wherein the patch is formed to have a center frequency of 5.8 gigahertz (GHz).

5. The antenna according to claim 1, wherein the patch is formed in a shape of any one of a circle, a triangle, a rectangle, and a polygon.

6. The antenna according to claim 1, further comprising an air gap slot formed in the patch, so as to control a frequency band of the antenna.

7. The antenna according to claim 6, wherein the air gap slot is formed in a shape of any one of a circle, a triangle, a rectangle, and a polygon.

8. The antenna according to claim 1, wherein the matching stubs are formed in a shape of any one of a rectangle, a trapezoid, and a circle, and are formed in an array form.

9. The antenna according to claim 1, wherein one of the matching stubs being adjacent to the feeder line has a width smaller than that of another one of the matching stubs.

10. The antenna according to claim 1, wherein the ground area is formed in a single patch form.

11. The antenna according to claim 10, further comprising an air gap slot formed within the ground area.

12. The antenna according to claim 11, wherein the air gap slot is formed in a shape of any one of a circle, a triangle, a rectangle, and a polygon.

13. The antenna according to claim 1, wherein the patch is formed on the substrate in one of a single-layered structure and a multi-layered structure.

14. The antenna according to claim 1, wherein an area of the patch is smaller than an area of the substrate such that the substrate completely surrounds the patch.

15. The antenna according to claim 1, wherein a length of the ground area extends along the entire length of the substrate and the height of the ground area extends to the position that is less than the edge of the patch to thereby form a single patch form ground area.

16. The antenna according to claim 1, wherein the plurality of matching stubs include a first stub directly contacting the patch and a second stub located between the first stub and the feeder line, and wherein a width of the second stub is less than a width of the first stub.

17. The antenna according to claim 16, wherein the patch is formed on a top middle surface of the substrate and is surrounded by the substrate, and the feeder line extends from an edge of the substrate to the second stub directly contacting the first stub.

18. The antenna according to claim 16, wherein a width of the first stub is less than a width of the second stub, and a width of the feeder line is less than a width of the second stub.

* * * * *